US005911183A

United States Patent [19]

Goto

[11] Patent Number: 5,911,183

[45] Date of Patent: Jun. 15, 1999

[54] EMBROIDERING DEVICE WITH UNDERBED SPLINED SHAFT

[75] Inventor: Hisaharu Goto, Nagoya, Japan

[73] Assignee: Aisin Seiki Kabushiki Kaisha, Kariya, Japan

[21] Appl. No.: 09/030,173

[22] Filed: Feb. 25, 1998

[51] Int. Cl.[6] ..... D05C 9/04

[52] U.S. Cl. ..... 112/103; 112/470.18

[58] Field of Search ..... 112/103, 470.14, 112/470.18, 475.11, 102, 308

[56] References Cited

U.S. PATENT DOCUMENTS

| | | | |
|---|---|---|---|
| 4,998,964 | 3/1991 | Golia | 112/103 X |
| 5,501,163 | 3/1996 | Molder et al. | 112/470.18 X |
| 5,503,093 | 4/1996 | Katou | 112/103 |
| 5,553,560 | 9/1996 | Tajima et al. | 112/470.18 X |

FOREIGN PATENT DOCUMENTS

| | | |
|---|---|---|
| 60-162853 | 8/1985 | Japan . |
| 7-40377 | 9/1995 | Japan . |

*Primary Examiner*—Ismael Izaguirre

*Attorney, Agent, or Firm*—Burns, Doane, Swecker & Mathis, L.L.P.

[57] ABSTRACT

An embroidering device includes a frame from which extends a motor driven and horizontally arranged splined shaft. A moving body in the form of a sleeve is mounted on the splined shaft. The sleeve is adapted to move axially along the shaft while being rotatable in unison with the shaft. A first holding body is fixed to the sleeve and is connected to a horizontally movable bracket. The bracket is connected to a driving mechanism so that upon operation of the driving mechanism the bracket and the first holding body move horizontally. A second holding body, which holds the work piece to be embroidered, is adapted to be mounted on the first holding body. The work piece to be embroidered is rotated by rotating the shaft and is moved horizontally by horizontally moving the bracket.

19 Claims, 3 Drawing Sheets

EMBROIDERING DEVICE WITH UNDERBED SPLINED SHAFT

This application claims priority under 35 U.S.C. §119 with respect to Japanese Application No. 09(1997)-41144, the entire content of which is incorporated herein by reference.

FIELD OF THE INVENTION

The present invention generally relates to the field of embroidering. More particularly, the present invention pertains to an embroidering device for embroidering generally cylindrically shaped work pieces such as caps.

BACKGROUND OF THE INVENTION

One type of known embroidering device is disclosed in Japanese Patent Laid-Open Publication No. 60-162853 published in 1985 without examination. Another known type of embroidering device is disclosed in Japanese Utility Model Publication No. 7-40377 published in 1995 after examination. These embroidering devices include a holder on which a cylindrical work piece, such as the main portion of a cap, is mounted to a bed. The embroidery process is carried out on the cylindrical work piece while the holder undergoes rotational and/or axial movement relative to the bed.

However, to establish the necessary rotational and/or axial movements of the holder, the structure of the embroidering device in the vicinity of the holder is rather complex and results in enlargement of the overall embroidering device.

SUMMARY OF THE INVENTION

A need exists, therefore, for an embroidering device which does not require the same complex structure as known embroidering devices.

A need also exists for an embroidering device whose size is not as large as the known types of embroidering devices mentioned above.

In light of the foregoing, the embroidering device of the present invention includes a frame, an arm extending from the frame, a needle extending from the distal end portion of the arm, a bed extending from the frame, and a sewing mechanism accommodated in the distal end portion of the bed for cooperating with the needle to establish embroidery on a work piece. A splined shaft extends from the frame in a position parallel to and spaced below the bed, and a moving body is mounted on the splined shaft so as to rotate with the splined shaft while being movable axially along the splined shaft. A first holding body is connected to the moving body by a connecting rod. The first holding body is positioned so that the bed and the splined shaft extend through the first holding body. A second holding body which is adapted to receive a work piece is removably mounted on the first holding body. A first driving mechanism is operatively connected to the splined shaft for rotating the splined shaft, and a second driving mechanism is operatively connected to the first holding body for moving the first holding body along the splined shaft independent of rotation of the splined shaft.

According to another aspect of the invention, an embroidering device includes a frame, an arm extending from the frame, a needle provided on the arm. a bed extending from the frame, a sewing mechanism accommodated in the bed for cooperating with the needle to establish embroidery on a work piece, a horizontally movable bracket mounted on the frame, and a first motor operatively connected to the bracket for horizontally moving the bracket. A first holding body is mounted on the bracket for being moved horizontally with the bracket, with the first holding body being connectable to a second holding body on which is mounted a work piece to be embroidered. A shaft extends through the first holding body so that the first holding body encircles the shaft, and a second motor is operatively connected to the shaft to effect rotation of the shaft. A mechanism is also provided for connecting the first holding body to the shaft to transfer rotation of the shaft into rotation of the first holding body.

Another aspect of the invention involves an embroidering device that includes a frame, an arm extending from the frame, a needle provided on the arm, a bed extending from the frame, a sewing mechanism accommodated in the bed for cooperating with the needle to establish embroidery on a work piece, a first holding body connectable to a second holding body on which is mounted a work piece to be embroidered, and a horizontal movement producing mechanism operatively connected to the first holding body for horizontally moving the first holding body. A shaft extends through the first holding body so that the first holding body encircles the shaft, and a motor is operatively connected to the shaft to effect rotation of the shaft. A sleeve is mounted on the shaft and is connected to the first holding body, with the sleeve being movable along the shaft and being rotatable in unison with the shaft.

BRIEF DESCRIPTION OF THE DRAWING FIGURES

The foregoing and additional features of the present invention will become more readily apparent from the following detailed description considered with reference to the accompanying drawing figures in which like elements are designated by like reference numerals and wherein.

DETAILED DESCRIPTION OF THE INVENTION

Figure 1:
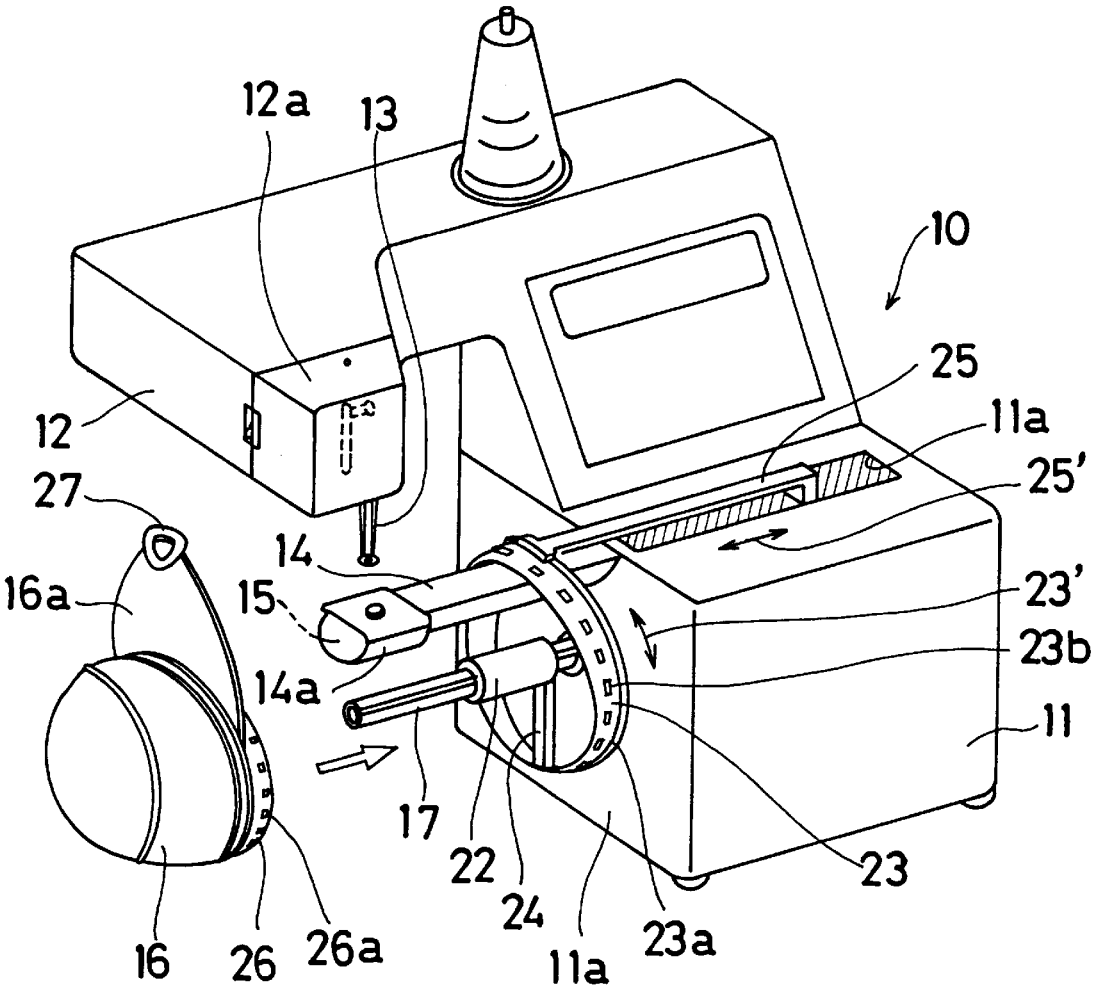
FIG. 1 is a perspective view of an embroidering device according to the present invention.

A preferred embodiment of the embroidering device according to the present invention is illustrated in FIGS. 1–4. With reference initially to FIG. 1, the embroidering device 10 according to the present invention includes a frame 11. An arm 12 is positioned near the top of the frame and extends from the frame 11 in the leftward direction as seen with reference to the view shown in FIG. 1, the arm 12 terminates at a distal free end portion 12*a*. A needle 13 depends downwardly from the distal free end portion 12*a* of the arm 12.

A bed 14 also extends from the frame 11 and is located below the arm 12. The bed 14 extends in the leftward direction as seen with reference to the view shown in FIG. 1 and terminates at a distal free end portion 14*a*. A sewing mechanism 15 is provided within the distal free end portion 14*a* of the bed 14. This sewing mechanism 15 cooperates with the needle 13 to establish embroidery on a generally cylindrically shaped work piece 16 held on the bed 14. In the illustrated embodiment, the generally cylindrically shaped work piece 16 is in the form of a cap. The structure and operation of the sewing mechanism 15 is known to persons skilled in the art and so a detailed description is not included here.

Figure 2:
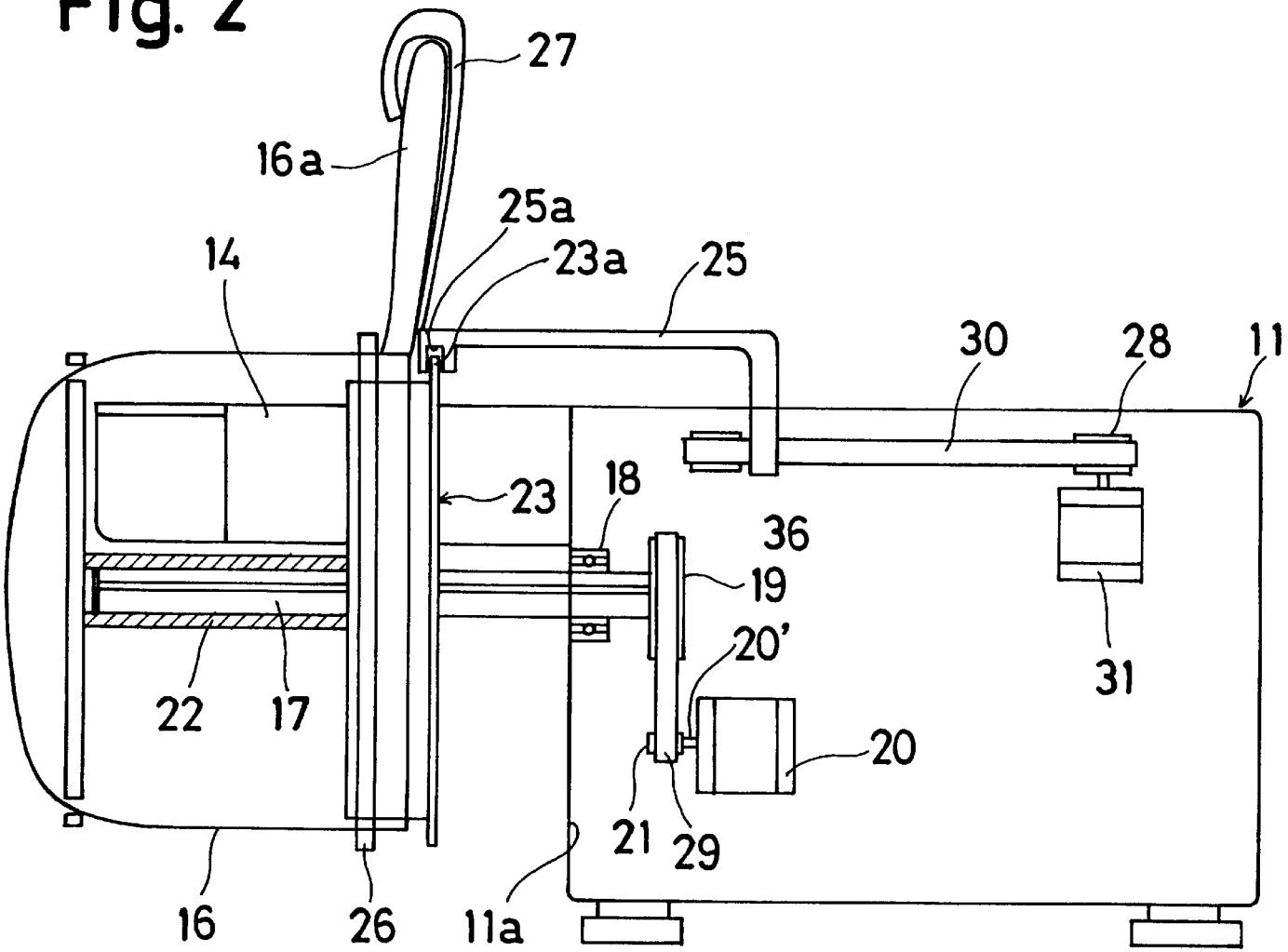
FIG. 2 is a cross-sectional view of a portion of the embroidering device shown in FIG. 1.

As depicted in FIGS. 1 and 2, a bracket 25 extends from within the frame 11. The bracket 25 is disposed above the bed 14 and is parallel to the bed 14. The bracket 25 passes through an elongated slot or opening 11*a* in an upper wall portion of the frame 11. The proximal end portion of the bracket 25 is located within the frame 11 and is fixedly connected to a belt 30 which bridges a pair of spaced apart pulleys 28 and 36 also located within the frame 11. On of the pulleys 28 is connected to the shaft of a motor 31. Thus, upon operation of the motor 31, the belt 30 moves and causes the bracket 25 to move in the horizontal direction as indicated by the arrow 25' shown in FIG. 1.

A splined shaft 17 passes through the left side wall 11*a* of the frame 11 and is positioned below the bed 14. The splined shaft 17 is positioned parallel to the bed 14 and the bracket 25. As seen with reference to FIG. 2, the proximal end portion of the splined shaft 17 is rotatably supported by a bearing 18 that is secured to the left side wall 11*a* of the frame 11. A pulley 19 is mounted on the proximal end portion of the splined shaft 17 so that the pulley 19 is located within the frame 11.

As further seen with reference to FIG. 2, a motor 20 is positioned within the frame 11. The motor 20 is provided with a shaft 20' and a pulley 21 is disposed at the end of the shaft 20'. A timing belt 29 extends around both the pulley 19 on the splined shaft 17 and the pulley 21 on the shaft 20' of the motor 20. Thus, when the motor 20 is turned on, the motor shaft 20' rotates and this rotation is transmitted to the splined shaft 17 via the pulley 21, the tug belt 29 and the pulley 19.

As seen in FIGS. 1 and 2, a moving body or sleeve 22 is mounted on the splined shaft 17. The moving body 22 is mounted on the splined shaft 17 and is configured with respect to the shaft 17 so that the moving body 22 rotates together with the splined shaft 17 when the rotational force is transmitted from the motor 20 to the splined shaft 17. In addition, the moving body 22 is configured so as to be able to move axially along the splined shaft 17 independent of rotation of the shaft 17.

A first annular holding body 23 is connected to the moving body 22 by a connecting rod 24. The first annular holding body 23 is disposed so that the splined shaft 17, the moving body 22 and the bed 14 are positioned radially within the outer confines of the first annular holding body 23. Thus, the first holding body 23 encircles the shaft 17 and the bed 14.

Figure 3:
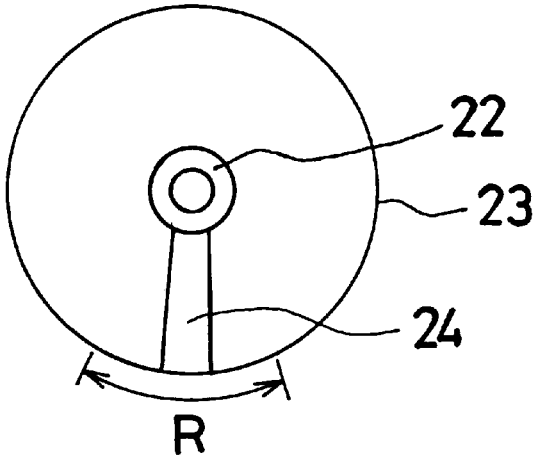
FIG. 3 is a front side view of the holding body forming a part of the embroidering device according to the present invention.

The first annular holding body 23 is positioned concentric with the splined shaft 17 and is designed to rotate in unison with the splined shaft 17 by virtue of the connection provided by the connecting rod 24. The first annular holding body 23 is adapted to rotate in the direction of the double headed arrow 23' in FIG. 1. To prevent interference between the connecting rod 24 and the bed 14, the motor 20 is designed so that a portion or range R on the first holding body 23 as seen in FIG. 3 is prevented from being brought into a position where embroidering on the work piece occurs. That is, rotational movement of the first holding body 23 is restricted, for example by a controller or microprocessor, so that the first holding body 23 only rotates through a rotational angle outside the range or portion R shown in FIG. 3.

The first annular holding body 23 is provided with a radially outwardly extending annular flange 23*a* that extends about the entire outer circumferential surface of the first annular holding body 23. As illustrated in FIG. 2, the annular flange 23*a* of the first annular holding body 23 is fitted in an inner groove 25*a* provided in the distal free end of the bracket 25. By fitting the annular flange 23*a* of the first holding body 23 in the inner groove 25*a* of the bracket 25, the first holding body 23 is free to rotate relative to the bracket 25, yet the first holding body 23 is caused to move horizontally along the splined shaft 17 as a result of horizontal movement of the bracket 25. Thus, rotational movement of the first holding body 23 is effected by operation of the motor 20 while horizontal movement of the first holding body 23 is effected through operation of the motor 31.

The cylindrical work piece or cap 16 is mounted on a second holding body 26 which is in the form of an annular member. The second holding body 26 is provided with an extension portion 27 that extends outwardly from the second holding body 26. The distal end of the extension portion 27 is folded back upon itself towards the second holding body 26 as seen in FIG. 2, thereby defining a holding clip for holding a portion of the cylindrical work piece such as the brim 16*a* of the cap 16.

A plurality of equally pitched or equally spaced apart apertures 26*a* are formed in the second holding body 26. The apertures 26*a* preferably pass completely through the second holding body 26. Each of the plurality of apertures 26*a* in the second holding body 26 is adapted to receive one of a plurality of equally pitched or equally spaced apart projections 23 formed on the outer surface of the first holding body 23. Thus, with the cylindrical work piece such as a cap 16 mounted on the second holding body 26, the second holding body 26 can be positioned relative to the first holding body 23 such that the end of the first holding body 23 is positioned within the second holding body 26. In this way, the projections 23*a* on the first holding body 23 will engage the openings 26*a* on the second holding body 26 and the cylindrical work piece or cap 16 will be ready for embroidering.

Under the condition shown in FIG. 2, the cap 16 is embroidered by the needle 13 and the sewing mechanism 15 which are operated in synchronization with operation of the motors 20, 31 by a controller or microprocessor. The operation of the motor 20 causes rotation of the splined shaft 17, the moving body 22, the connecting rod 24 and the first holding body 23. The rotation of the first holding body 23 causes concurrent rotation of the second holding body 26 by virtue of the engagement of the projections 23*a* on the first holding body 23 and the openings 26*a* on the second holding body 26. Thus, the operation of the motor 20 as controlled by the controller or microprocessor results in rotation of the cylindrical work piece or cap 16. Also, the operation of the motor 31 causes horizontal movement of the bracket 25 which causes concurrent horizontal movement of the first holding body 23 and the second holding body 26. Thus, the operation of the motor 31 as controlled by the controller or microprocessor effects horizontal movement of the cylindrical work piece or cap 16.

Figure 4:
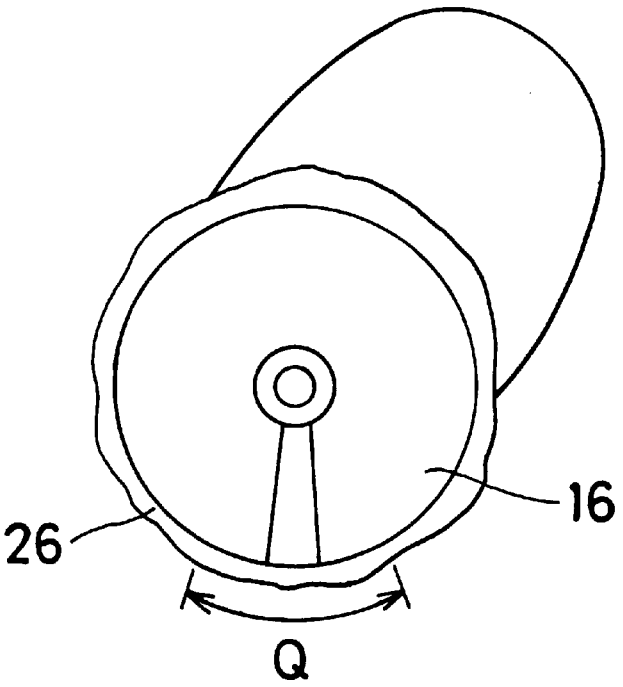
FIG. 4 is a view similar to FIG. 3 showing the holding body on which is held a cylindrical shaped work piece in the form of a cap.

It is to be noted that prior to starting the embroidery process, the work piece or cap 16 must be moved to a position such the part of the work piece or cap 16 to be embroidered is located beneath the needle 13. Such a transfer or movement can be established by horizontal movement of the moving body 22 along the splined shaft 17. Also, a range Q of the work piece or cap 16 as seen in FIG. 4 which is not to be embroidered has to be positioned in coincidence with the range R of the first holding body 23 shown in FIG. 3.

In the embroidering device having the foregoing structure, the work piece 16 to be embroidered, which is in the form of a cap 16, is held by the second holding body 26 which is engaged with the first holding body 23. In this state, the work piece or cap 16 is rotated and/or moved horizontally relative to the frame 11 to effect the desired embroidery pattern. Because the first and the second holding bodies 23, 26 constitute elements that are independent of the frame 11, the structure of the embroidering device in the vicinity of the frame is much more simple than in other known devices.

The principles, a preferred embodiment and the mode of operation of the present invention have been described in the foregoing specification. However, the invention which is intended to be protected is not to be construed as limited to the particular embodiment described. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the invention be embraced thereby.

What is claimed is:

1. An embroidering device comprising:

a frame;

an arm extending from the frame and having a distal end portion;

a needle extending from the distal end portion of the arm;

a bed extending from the frame and having a distal end portion;

a sewing mechanism accommodated in the distal end portion of the bed for cooperating with the needle to establish embroidery on a work piece;

a splined shaft extending from the frame, said splined shaft being positioned parallel to and below the bed;

a moving body mounted on the splined shaft, said moving body being rotatable with the splined shaft and being movable along the splined shaft;

a first holding body through which the bed and the splined shaft extend;

a connecting rod connecting the first holding body to the moving body;

a second holding body adapted to receive a work piece and adapted to be removably mounted on the first holding body;

a first driving mechanism operatively connected to the splined shaft for rotating the splined shaft; and a second driving mechanism operatively connected to the first holding body for moving the first holding body along the splined shaft independent of rotation of the splined shaft.

2. An embroidering device as set forth in claim 1, wherein the second holding body includes an extension having an end portion that is bent back upon itself for engaging a portion of the work piece.

3. An embroidery device as set forth in claim 1, wherein the second driving mechanism includes a bracket extending from the frame, said bracket having a distal end provided with a groove, the first holding body including an annular flange positioned within the groove in the distal end of the bracket.

4. An embroidering device as set forth in claim 1, wherein the first driving mechanism includes a motor having a shaft that is operatively connected to the splined shaft by a belt.

5. An embroidering device comprising:

a frame;

an arm extending from the frame;

a needle provided on the arm;

a bed extending from the frame;

a sewing mechanism accommodated in the bed for cooperating with the needle to establish embroidery on a work piece;

a bracket mounted for horizontal movement with respect to the frame;

a first motor operatively connected to the bracket for horizontally moving the bracket;

a first holding body mounted on the bracket for being moved horizontally with the bracket, the first holding body being connectable to a second holding body on which is mounted a work piece to be embroidered;

a shaft extending through the first holding body so that the first holding body encircles the shaft;

a second motor operatively connected to the shaft to effect rotation of the shaft; and means for connecting the first holding body to the shaft to transfer rotation of the shaft into rotation of the first holding body.

6. An embroidering device as set forth in claim 5, wherein the first holding body includes a radially outwardly extending flange and the bracket includes a groove that receives the flange on the first holding body.

7. An embroidery device as set forth in claim 5, wherein the bracket is connected to a belt that is driven by the first motor.

8. An embroidery device as set forth in claim 5, wherein the shaft is splined.

9. An embroidery device as set forth in claim 5, wherein the means for connecting the first holding body to the shaft includes a sleeve mounted on the shaft and a connecting arm connecting the sleeve to the first holding body.

10. An embroidery device as set forth in claim 9, wherein the shaft is splined.

11. An embroidery device as set forth in claim 5, wherein said first holding body includes a plurality of radially outwardly extending projections for engaging openings on the second holding body when the second holding body is mounted on the first holding body.

12. An embroidering device as set forth in claim 5, wherein the bed is spaced apart from the shaft and is positioned parallel to the shaft.

13. An embroidery device as set forth in claim 12, wherein the bed extends through the first holding body so that the first holding body encircles the bed.

14. An embroidering device comprising:

a frame;

an arm extending from the frame;

a needle provided on the arm;

a bed extending from the frame;

a sewing mechanism accommodated in the bed for cooperating with the needle to establish embroidery on a work piece;

a first holding body connectable to a second holding body on which is mounted a work piece to be embroidered;

horizontal movement producing means operatively connected to the first holding body for horizontally moving the first holding body;

a shaft mounted for rotational movement with respect to the frame and extending through the first holding body so that the first holding body encircles the shaft;

a motor operatively connected to the shaft to effect rotation of the shaft; and a sleeve mounted on the shaft and connected to the first holding body, said sleeve being rotatable in unison with the shaft and being movable axially along the shaft independent of rotation of the shaft.

15. An embroidery device as set forth in claim 14, wherein the bed extends through the first holding body so that the first holding body encircles the bed, said bed being parallel to the shaft.

16. An embroidery device as set forth in claim 14, wherein the horizontal movement producing means includes a bracket connected to a motor, the bracket having a groove that receives a radially outwardly extending flange on the first holding body.

17. An embroidery device as set forth in claim 14, wherein the shaft is splined.

18. An embroidery device as set forth in claim 14, wherein the sleeve is connected to the first holding body by way of a connecting arm.

19. An embroidery device as set forth in claim 14, wherein the shaft and the bed are parallel to one another.

* * * * *

UNITED STATES PATENT AND TRADEMARK OFFICE

CERTIFICATE OF CORRECTION

PATENT NO. : 5,911,183

DATED : June 15, 1999

INVENTOR(S) : GOTO

It is certified that error appears in the above-indentified patent and that said Letters Patent is hereby corrected as shown below:

On the cover page, the following is added:

[30] Foreign Application Priority Data

Feb. 25, 1997 [JP] Japan ..... 9-41144 (P)

Signed and Sealed this

Fourth Day of January, 2000

*Attest:*

*Attesting Officer*

*Acting Commissioner of Patents and Trademarks*